US007460004B1

(12) United States Patent
Yang

(10) Patent No.: US 7,460,004 B1
(45) Date of Patent: Dec. 2, 2008

(54) CIRCUIT PROTECTION DEVICE WITH CUTOUT WARNING EFFECT

(75) Inventor: Ming-Lin Yang, Hsinchu (TW)

(73) Assignee: Photo-Top Technologies Co., Ltd., Hsin-Chu (TW)

( * ) Notice: Subject to any disclaimer, the term of this patent is extended or adjusted under 35 U.S.C. 154(b) by 13 days.

(21) Appl. No.: 11/768,557

(22) Filed: Jun. 26, 2007

(51) Int. Cl.
*H01H 85/30* (2006.01)

(52) U.S. Cl. ..... 337/206; 337/241; 337/242; 337/265; 337/266; 337/186; 337/187

(58) Field of Classification Search ..... 337/206, 337/241, 242, 186, 187, 265, 266
See application file for complete search history.

(56) References Cited

U.S. PATENT DOCUMENTS

| | | | | | |
|---|---|---|---|---|---|
| 2,471,848 | A * | 5/1949 | Von Hoorn | ..... | 337/201 |
| 4,499,447 | A * | 2/1985 | Greenberg | ..... | 337/266 |
| 4,857,896 | A * | 8/1989 | Brooks | ..... | 340/639 |
| 4,887,975 | A * | 12/1989 | Jarred | ..... | 439/490 |
| 5,598,138 | A * | 1/1997 | Jaronczyk, Jr. | ..... | 337/265 |
| 5,659,283 | A * | 8/1997 | Arratia | ..... | 337/206 |
| 5,701,118 | A * | 12/1997 | Hull et al. | ..... | 340/638 |
| 6,448,897 | B1 * | 9/2002 | Ku | ..... | 340/638 |
| 6,859,131 | B2 * | 2/2005 | Stanek et al. | ..... | 337/206 |
| 7,049,973 | B2 * | 5/2006 | Torrez et al. | ..... | 340/638 |
| 2004/0257191 | A1 * | 12/2004 | Muller | ..... | 337/159 |
| 2005/0035842 | A1 * | 2/2005 | Shyu | ..... | 337/265 |
| 2006/0017540 | A1 * | 1/2006 | Smith | ..... | 337/242 |

FOREIGN PATENT DOCUMENTS

DE 3743482 A1 * 7/1989

* cited by examiner

*Primary Examiner*—Anatoly Vortman
(74) *Attorney, Agent, or Firm*—Dykema Gossett PLLC

(57) ABSTRACT

A circuit protection device includes a case having a transverse top portion provided with a central receiving opening and two locating holes, and two wall portions downward extended from a middle part of the transverse top portion to define a receiving space therebetween for communicating with the receiving opening and locating holes; a cutout unit having two conducting plates connected via a bridge portion, and being inserted in the receiving space with the conducting plates engaged with the locating holes and partially projected from two longitudinal edges of the wall portions; and a bipolar LED mounted in the receiving opening and having a conducting portion in contact with two pins of the cutout unit, and a light source. In an overcurrent state, the bridge portion is burned out, and current flows through the bipolar LED for the same to emit light as a cutout warning signal.

6 Claims, 7 Drawing Sheets

CIRCUIT PROTECTION DEVICE WITH CUTOUT WARNING EFFECT

FIELD OF THE INVENTION

The present invention relates to a circuit protection device, and more particularly to a circuit protection device that is stably and firmly embedded in a socket on an electronic apparatus and provides a cutout warning effect.

BACKGROUND OF THE INVENTION

In FIG. 7, there is shown a conventional circuit protection device, which includes a case 5, two terminals 6 set in and partially projected from and end of the case 5, and a fuse (not shown) connected to and between the two terminals 6. The two terminals 6 partially projected from the case 5 are plugged into a socket 7 provided on an electronic apparatus. In case of an overcurrent state, the fuse is burned out to form an open circuit between the two terminals 6, preventing the abnormal current from flowing to the electronic apparatus via the terminals 6, so as to achieve the effect of protecting the electronic apparatus.

The above-structured circuit protection device provides the function of protecting the electronic apparatus against overcurrent. However, since the terminals 6 have only a very short part projected from the case 5 for plugging into the socket 7, there is only a small and insufficient interference drag between the socket 7 and the terminals 6, resulting in an unstable and swaying circuit protection device in the socket 7. Moreover, the conventional circuit protection device shown in FIG. 7 does not include any means for warning a user when the fuse between the two terminals 6 is burned out to form an open circuit due to an overcurrent.

SUMMARY OF THE INVENTION

A primary object of the present invention is to provide a circuit protection device that includes a light source for emitting light as a warning signal when the circuit protection device is cut out in an overcurrent state.

Another object of the present invention is to provide a circuit protection device with cutout warning effect that can be stably and firmly embedded in a socket correspondingly provided on an electronic apparatus.

To achieve the above and other objects, the circuit protection device with cutout warning effect according to a preferred embodiment of the present invention includes a case having a transverse top portion provided with a central receiving opening and two locating holes at two opposite sides of the receiving opening, and two wall portions downward extended from a middle part of the transverse top portion to define a receiving space therebetween for communicating with the receiving opening and locating holes; a cutout unit having at least two conducting plates connected to each other via a bridge portion, and being inserted in the receiving space with the two conducting plates partially extended from two longitudinal edges of the wall portions, and the conducting plates being respectively provided at an end with a protrusion for engaging with the locating holes and at a position adjacent to the protrusion with a pin; and a bipolar LED mounted in the receiving opening with a conducting portion thereof in contact with the pins of the cutout unit, and a light source for emitting and projecting light through the receiving opening as a warning signal in a cutout state.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
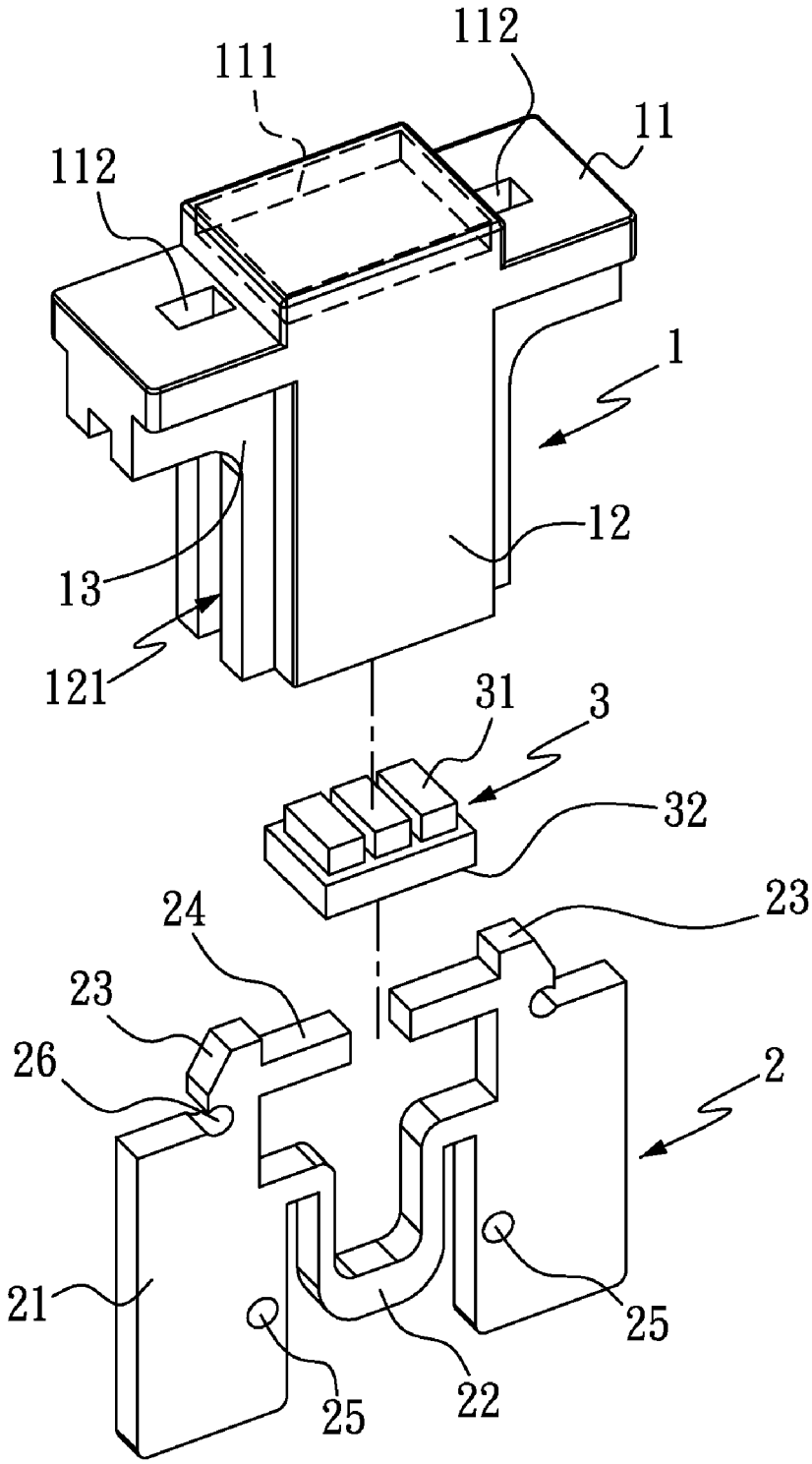
FIG. 1 is an exploded perspective view of a circuit protection device with cutout warning effect according to a preferred embodiment of the present invention.
Figure 2:
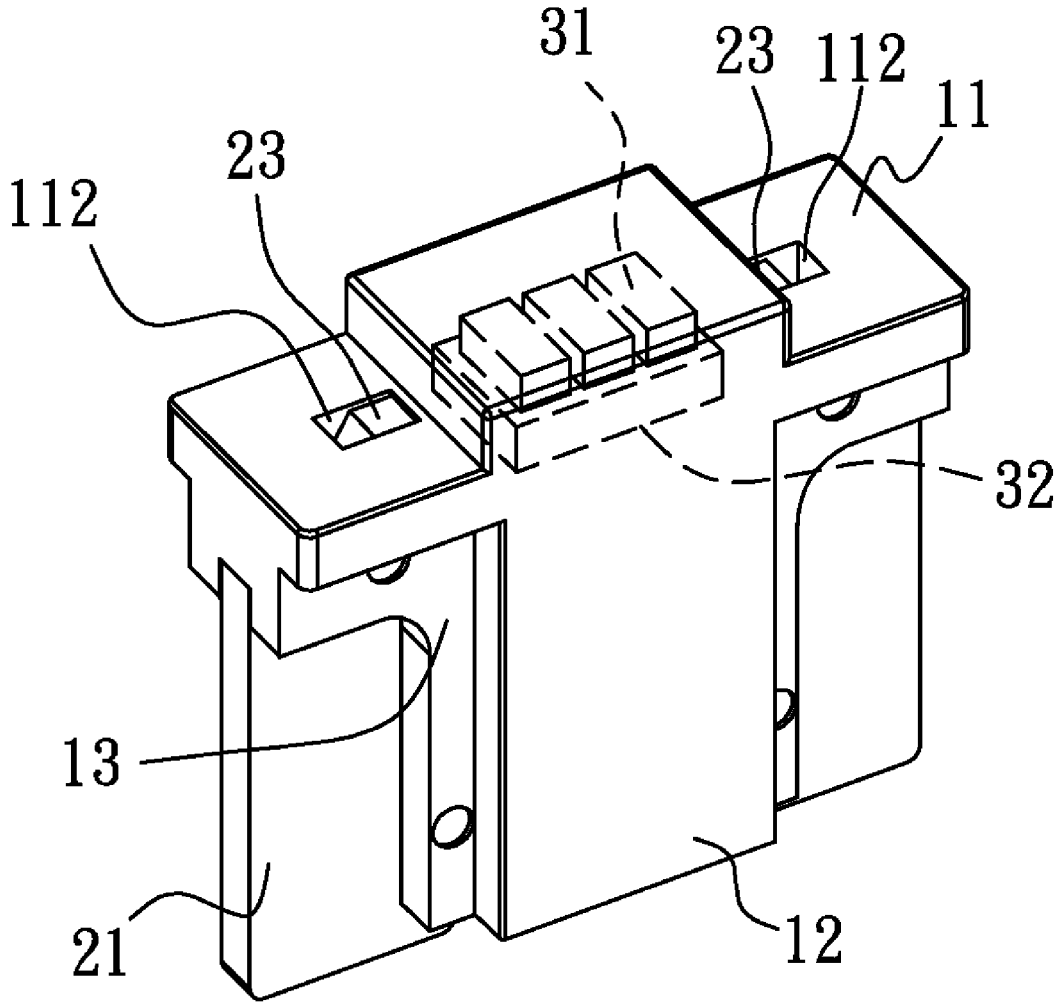
FIG. 2 is an assembled view of FIG. 1.
Figure 3:
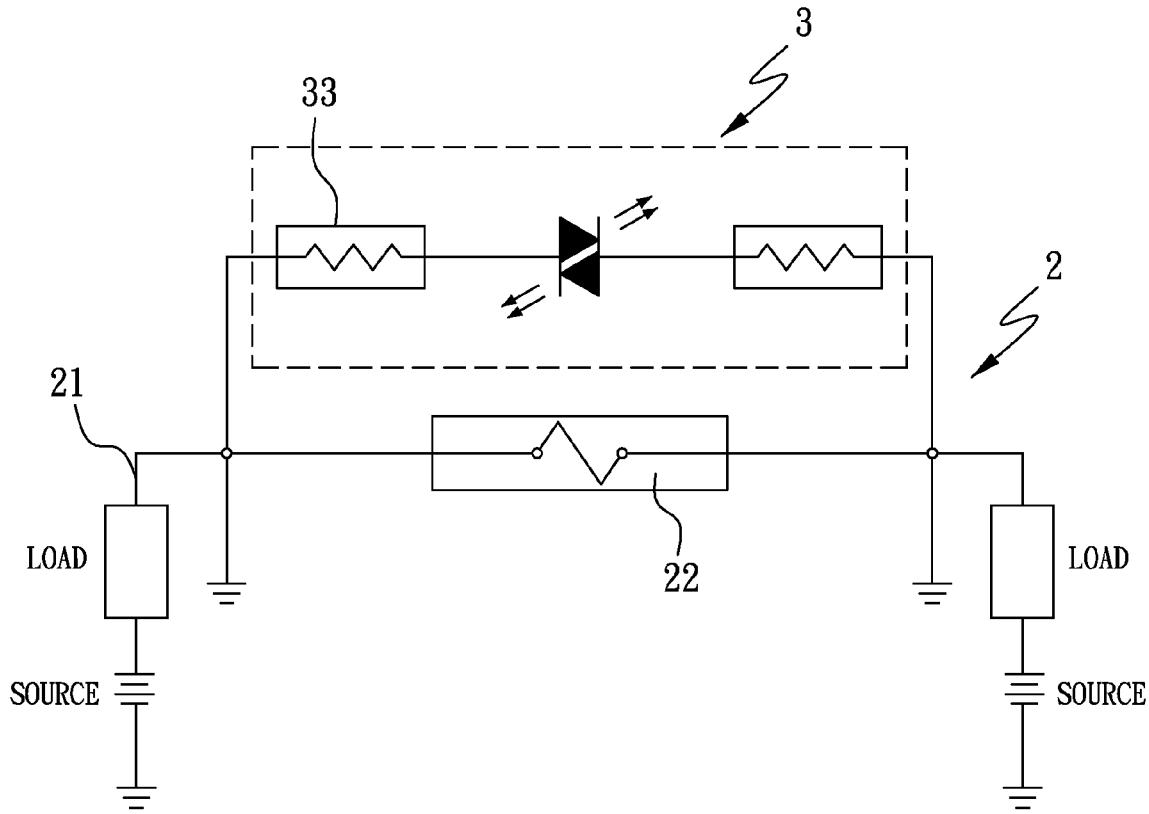
FIG. 3 is an equivalent circuit diagram for the present invention.

Please refer to FIGS. 1 and 2 that are exploded and assembled perspective views, respectively, of a circuit protection device with cutout warning effect according to a preferred embodiment of the present invention, and to FIG. 3 that is an equivalent circuit diagram for the present invention. As shown, the circuit protection device with cutout warning effect according to the present invention includes a case 1, a cutout unit 2, and a bipolar light-emitting diode (LED) 3.

The case 1 is substantially a T-shaped member having a transverse top portion 11 provided with a central receiving opening 111 and two locating holes 112 formed at two opposite ends of the receiving opening 111, and a wall portion 12 downward extended from a middle part of each of two opposite sides of the transverse top portion 11. The two wall portions 12 together define a receiving space 121 therebetween to communicate with the receiving opening 111 and the two locating holes 112. An extended portion 13 is provided along and between each longitudinal edge of each wall portion 12 and the transverse top portion 11. The whole case 1 or at least the receiving opening 111 of the case 1 is made of a light-pervious material.

The cutout unit 2 includes at least two electrically conducting plates 21, and a bridge portion 22 extended between and connected to the two conducting plates 21. The cutout unit 2 is configured for locating in the receiving space 121 of the case 11 with the two conducting plates 21 partially projected from the two longitudinal edges of the two wall portions 12. The two conducting plates 21 are respectively provided at an end with a protrusion 23 for correspondingly inserting into the two locating holes 112, and at positions adjacent to an inner side of the two protrusions 23 with two corresponding pins 24. Each of the two conducting plates 21 is also formed at positions in the vicinity of the bridge portion 22 and the protrusion 23 with fixing holes 25 and 26, respectively, corresponding to the extended portions 13 of the case 1. When the case 1 and the cutout unit 2 are associated with each other by way of heat pressing, part of the plastic material forming the extended portions 13 is molten to flow into and set in the fixing holes 25, 26.

The bipolar LED 3 is mounted in the receiving opening 111 of the case 1, and is provided at one side with a light source portion 31 corresponding to the receiving opening 111, and at the other opposite side with a conducting portion 32 for electrically contacting with the pins 24 on the conducting plates 21. The bipolar LED 3 is internally provided with voltage dividing elements 33 for electrically connecting the conducting portion 32 to the pins 24. The bipolar LED 3 may be a surface-mount device (SMD), and has two conducting layers of different polarities grown on a chip thereof, so that the bipolar LED 3 may be electrically connected to the conducting plates 21 without the necessity of particularly selecting a positive or a negative polarity, and there is always one conducting layer in an electrically connectable state. The bipolar LED 3 provides the circuit protection device of the present invention with a cutout warning effect.

Figure 4:
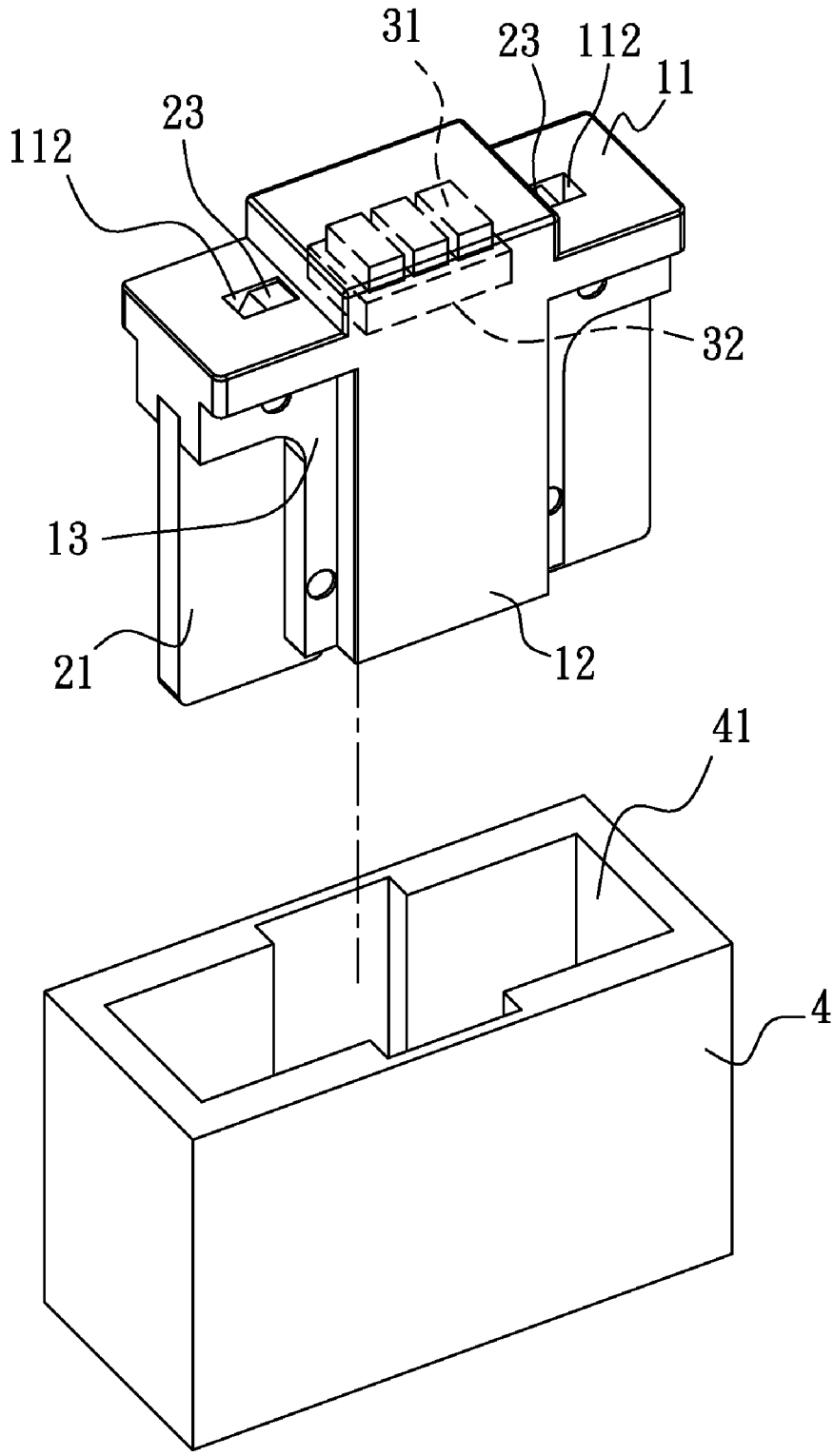
FIG. 4 is an exploded perspective view showing the mounting of the circuit protection device of the present invention into a socket on an electronic apparatus.
Figure 5:
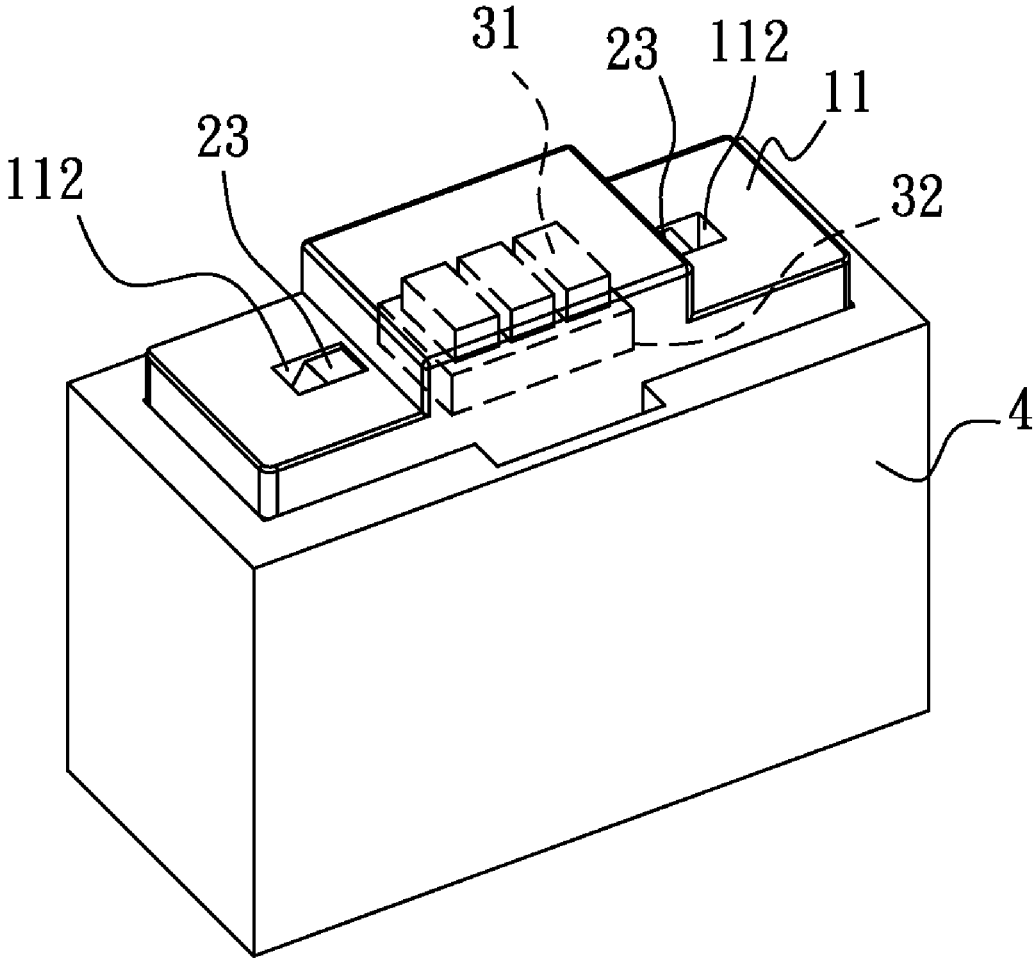
FIG. 5 is an assembled view of FIG. 4.
Figure 6:
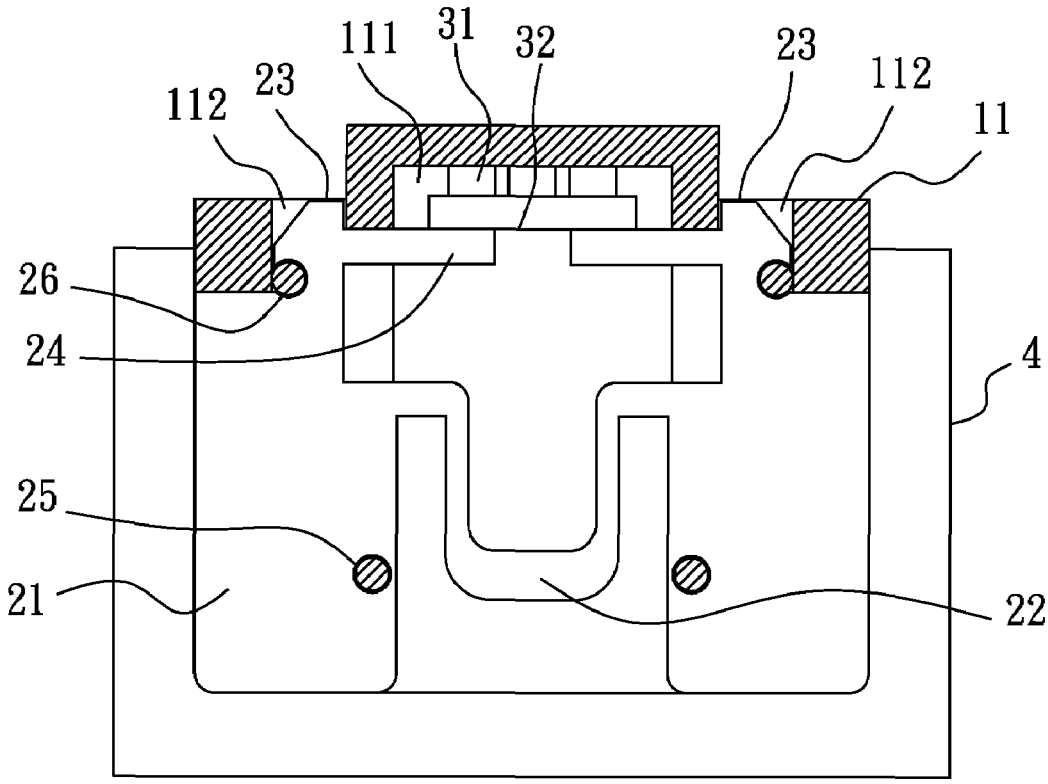
FIG. 6 is a sectional view of FIG. 5.
Figure 7:
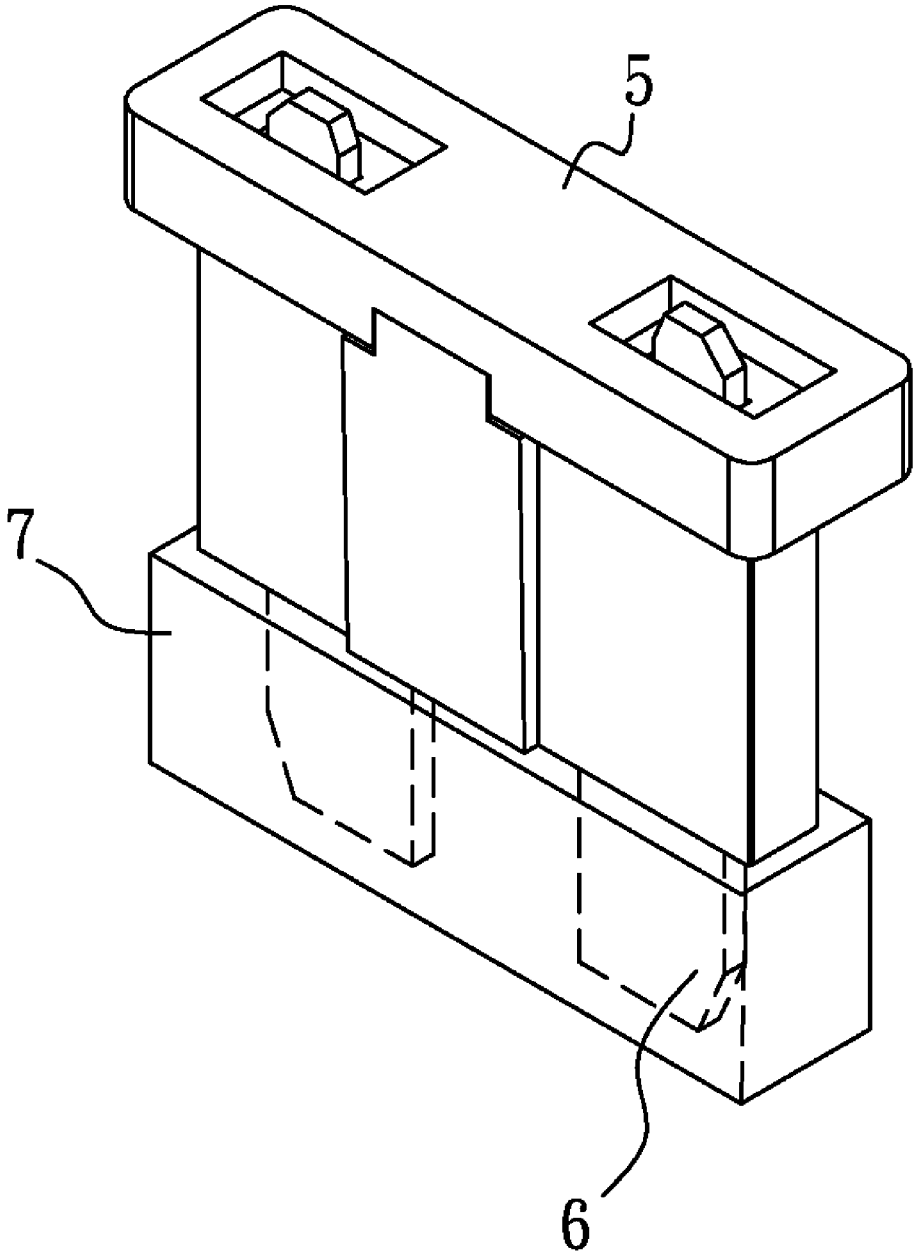
(PRIOR ART) Fig. 7
FIG. 7 is a perspective view of a conventional circuit protection device.

FIGS. 4 and 5 are exploded and assembled perspective views, respectively, showing the mounting of the circuit protection device of the present invention into a socket on an electronic apparatus; and FIG. 6 is a sectional view of FIG. 5. The circuit protection device of the present invention may be inserted into a socket 4 correspondingly provided on an electronic apparatus (not shown) for use. As shown, when the circuit protection device is inserted into the socket 4 on the electronic apparatus, the two wall portions 12 of the case 1 and the portions of the two conducting plates 21 projected from the two longitudinal edges of the wall portions 12 are completely received in a hollow space 41 in the socket 4 with only the transverse top portion 11 protruded from the socket 4 and the two conducting plates 21 in electrical contact with the socket 4. Therefore, the circuit protection device of the present invention is stably and firmly embedded in the socket 4 on the electronic apparatus.

In a normal operating state, a supplied current flows through the two conducting plates 21 via the bridge portion 22 to form a close circuit. That is, the current is supplied to the electronic apparatus via the cutout unit 2. When there is an overcurrent state, the bridge portion 22 is burned out and broken to cause an open circuit between the two conducting plates 21, bringing the current to flow through the bipolar LED 3 for the light source portion 31 of the bipolar LED 3 to emit light, which passes through the receiving opening 111 to form a warning signal of abnormal circuit on the electronic apparatus. With these arrangements, the bridge portion 22 between the two conducting plates 21 on the cutout unit 2 and the bipolar LED 3 together provide a cutout warning effect.

With the bridge portion 22 between the two conducting plates 21 on the cutout unit 2 and the bipolar LED 3, the circuit protection device according to the present invention provides a cutout warning effect to thereby effectively overcome the drawbacks in the prior art. Moreover, since the two conducting plates 21 of the cutout unit 2 and the case 1 of the circuit protection device according to the present invention are stably and firmly embedded in the socket correspondingly provided on the electronic apparatus, the circuit protection device is more durable and reliable for use.

What is claimed is:

1. A circuit protection device with cutout warning effect, comprising:

a case having a transverse top portion provided with a central receiving opening and two locating holes formed at two opposite ends of the receiving opening, and a wall portion downward extended from a middle part of each of two opposite sides of the transverse top portion; the two wall portions together defining a receiving space therebetween to communicate with the receiving opening and the two locating holes;

a cutout unit including at least two electrically conducting plates, and a bridge portion extended between and connected to the two conducting plates; the cutout unit being configured for locating in the receiving space of the case with the two conducting plates partially projected from two opposite longitudinal edges of the two wall portions; the two conducting plates being respectively provided at an end with a protrusion for correspondingly inserting into the two locating holes on the transverse top portion of the case, and at positions adjacent to an inner side of the two protrusions with two corresponding pins; and each of the two conducting plates also being formed at positions in the vicinity of the bridge portion and the protrusion with a fixing hole each; and a bipolar LED being mounted in the receiving opening of the case, and provided at one side with a light source portion corresponding to the receiving opening, and at the other opposite side with a conducting portion for electrically contacting with the pins on the conducting plates.

2. The circuit protection device with cutout warning effect as claimed in claim 1, wherein the case is substantially a T-shaped member.

3. The circuit protection device with cutout warning effect as claimed in claim 1, wherein the case is made of a light-pervious material.

4. The circuit protection device with cutout warning effect as claimed in claim 1, wherein at least the receiving opening on the case is made of a light-pervious material.

5. The circuit protection device with cutout warning effect as claimed in claim 1, further comprising an extended portion provided along and between each longitudinal edge of the wall portions and the transverse top portion of the case.

6. The circuit protection device with cutout warning effect as claimed in claim 1, wherein the bipolar LED is internally provided with voltage dividing elements for electrically connecting the conducting portion of the bipolar LED to the pins of the cutout unit.

* * * * *